United States Patent [19]

Matsuda

[11] Patent Number: 4,647,518

[45] Date of Patent: Mar. 3, 1987

[54] LIGHT-EMITTING DISPLAY COMPONENT AND METHOD FOR LIGHT-EMITTING DISPLAY USING THE SAME

[75] Inventor: Hiroshi Matsuda, Yokohama, Japan

[73] Assignee: Canon Kabushiki Kaisha, Tokyo, Japan

[21] Appl. No.: 724,299

[22] Filed: Apr. 17, 1985

[30] Foreign Application Priority Data

Apr. 20, 1984 [JP] Japan ..... 59-78598

[51] Int. Cl.[4] ..... G03C 1/68; G03C 5/16; G03C 5/00

[52] U.S. Cl. ..... 430/21; 430/19; 430/270; 430/281; 430/328; 430/905

[58] Field of Search ..... 430/19, 21, 281, 905, 430/270, 328

[56] References Cited

U.S. PATENT DOCUMENTS 3,843,382 10/1974 Zweig ..... 430/495
4,562,141 12/1985 Tieke ..... 430/281

FOREIGN PATENT DOCUMENTS 0035587 3/1977 Japan .

*Primary Examiner*—Richard C. Schilling
*Attorney, Agent, or Firm*—Fitzpatrick, Cella Harper & Scinto

[57] ABSTRACT

A light-emitting display component has a light-emitting display layer made of a monomolecular layers of inclusion complex compounds each comprising host molecules and guest molecules.

22 Claims, 6 Drawing Figures

LIGHT-EMITTING DISPLAY COMPONENT AND METHOD FOR LIGHT-EMITTING DISPLAY USING THE SAME

BACKGROUND OF THE INVENTION

1. Field of the Invention

This invention relates to a light-emitting display component, particularly to a light-emitting display component having a monomolecular layer of an inclusion complex compound comprising two different compounds as a light-emitting display layer, and also to a method for light-emitting display using said component.

2. Description of the Prior Art

Heretofore, several types of light-emitting display components using fluorescent organic compounds have been proposed [for example, see Japanese Patent Application Kokai (Laid-open) No. 35587/1977, and Japanese Patent Publication No. 172891/1983]. All these prior art proposals relate to the so-called EL (electroluminescent) light-emitting display components having light-emitting display layers of electroluminescent compounds, which can emit light upon application of voltage. Particularly, the component disclosed in Japanese Patent Application Kokai (Laid-open) No. 35587/1977 is prepared by forming a monomolecular layer of derivatives of anthracene, pyrene or perylene each having a hydrophilic group and a hydrophobic group at appropriate positions, or a monomolecular layers-built up film on an electrode plate, and then depositing the second electrode on the film.

However, to make display, i.e., to form an image, utilizing said component according to given information, it is necessary to form the electrode into the desired image pattern or on the matrix in advance, and thus the display component of high resolving power cannot be obtained owing to the technical difficulty in forming the electrode. Furthermore, to obtain the display component of high resolving power, it is desirable that the distribution of luminous molecules in the layer have a high orderliness, but careful and complicated operations are required for forming such a monomolecular layer or a monomolecular layers-built up film with a high orderliness from said derivatives of anthracene, etc. These are the disadvantages of the prior art.

SUMMARY OF THE INVENTION

As a result of extensive studies of preparing the light-emitting display component which is free from said disadvantages of the prior art and capable of displaying highly densed information through light emission and also of cancelling the information (discontinuing the display) to display new information, the present inventor has found that the disadvantages of the prior art can be eliminated and said object can be attained by using a monomolecular layer of an inclusion complex compound containing a light-emitting compound as a guest molecule in the light-emitting display component, and has established the present invention.

One aspect of the present invention is to provide a light-emitting display component, which comprises a light-emitting display layer made of a monomolecular layer of inclusion complex compounds each comprising host molecules each having a hydrophilic site, a hydrophobic site and an inclusion site in the molecule and guest molecules included in the host molecules, where the guest molecule is the molecule of the compound that emits light in the monomer state by receiving external energy, and fails to emit light in the dimer state.

The second aspect of the present invention is to provide a method for light-emitting display, which comprises subjecting a light-emitting display component, which comprises a light-emitting display layer made of a monomolecular layer of inclusion complex compounds each comprising host molecules each having a hydrophilic site, a hydrophobic site and an inclusion site in the molecule and guest molecules included in the host molecules, where the guest molecule is the molecule of the compound that emits light in the monomer state by receiving external energy and fails to emit light in the dimer state, to irradiation by external energy according to given information, thereby dimerizing the guest molecules, and then subjecting the entire surface of the component to ultraviolet light exposure, thereby making display according to the input information The third aspect of the present invention is to provide a method for light-emitting display, which comprises subjecting the entire surface of a light-emitting display component, which comprises a light-emitting display layer made of a monomolecular layer of inclusion complex compounds each comprising host molecules each having a hydrophilic site, a hydrophobic site and an inclusion site in the molecule and guest molecules included in the host molecules, where the guest molecule is the molecule of the compound that emits light in the monomer state by receiving external energy and fails to emit light in the dimer state, to exposure by light having a specific wavelength, thereby dimerizing at least the guest molecules, then subjecting the light-emitting display component to irradiation by ultraviolet light having a given wavelength according to a given pattern, thereby depolymerizing the dimerized guest molecules, and then subjecting the entire surface of the component to exposure by ultraviolet light having another wavelength, thereby making display according to the input information.

DESCRIPTION OF THE PREFERRED EMBODIMENTS

Figure 1:
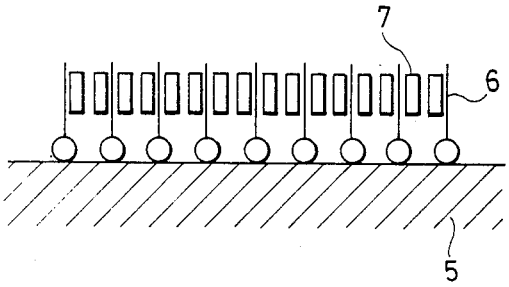
FIGS. 1, 2 and 3 are structural views of a monomolecular layer of inclusion complex compounds for a light-emitting display layer according to the present invention.

The substrate for use in the present invention is not particularly limited, and any of the known substrates for light-emitting display components can be used. For example, transparent substrates of glass, plastic, quartz, etc. are preferably used, where the substrates having clean surfaces are more preferable. If their surfaces are contaminated, there is a possibility of disturbance in the evenness of a monomolecular layer formed thereon.

The light-emitting display layer to be formed on the substrate is made of inclusion complex compounds each comprising two different compounds, that is, a compound having hydrophilic group and or a hydrophobic group and at least one site capable of including another molecule in the molecule (hereinafter referred to as a host molecule) and another compound capable of being included in the above compound (hereinafter referred to as a guest molecule). The present, light-emitting display component can be prepared by forming a monomolecular layer of said inclusion complex compounds each comprising host molecules and guest molecules on said substrate, preferably a transparent substrate.

Any compound can be used as host molecules in the present invention, so long as it is a compound having a hydrophilic group and a hydrophobic group and at least one site capable of including a guest molecule at appropriate positions in the molecule. The site capable of including a guest molecule can be produced by introduction of a group having an atom capable of forming a hydrogen bond such as a hydroxyl group, a carbonyl group, a carboxyl group, an ester group, a nitro group, an amido group, an amino group, a nitrile group, a thioalcohol group, an imino group, etc. Above all, the molecule having a hydroxyl group as and the inclusion site is most preferable, where the structures can be represented, for example, by the following general formulae:

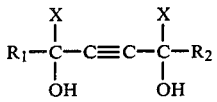

(Ia)

-continued

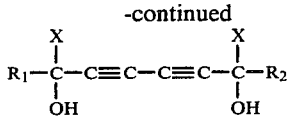

(Ib)

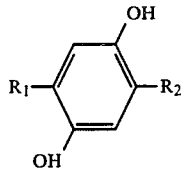

(Ic)

where X is a hydrogen atom or a phenyl group, and $R_1$ and $R_2$ are groups as given below.

In the foregoing formulae, it is necessary that a hydrophilic site exists at one of $R_1$ moiety and $R_2$ moiety, and a hydrophobic site at the other moiety, or that both $R_1$ moiety and $R_2$ moiety are hydrophilic or hydrophobic together relatively to the other moieties of the molecule. On the other hand, it is preferable that the $R_1$ and $R_2$ moieties are linear alkyl groups each having particularly 5 to 30 carbon atoms when the hydrophobic site is introduced thereto, and fatty acids having particularly 1 to 30 carbon atoms when the hydrophilic site is introduced thereto.

Preferable specific examples of the host molecules of the present invention include the following compounds:

(I. Acetylenediol derivatives)

(1)

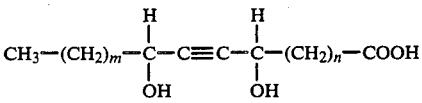

$(30 \geqq m + n \geqq 11, n \geqq 0)$ (2)

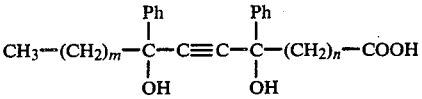

$(30 \geqq m + n \geqq 11, n \geqq 0)$ (3)

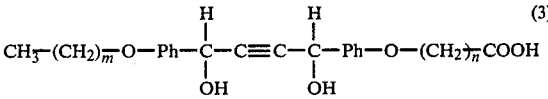

$(30 \geqq m + n \geqq 8, n \geqq 1)$ (4)

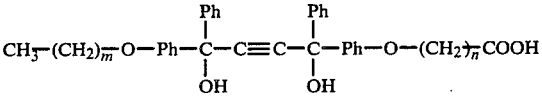

$(30 \geqq m + n \geqq 8, n \geqq 1)$ (5)

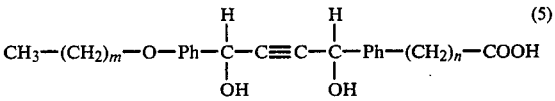

$(30 \geqq m + n \geqq 8, n \geqq 0)$ (6)

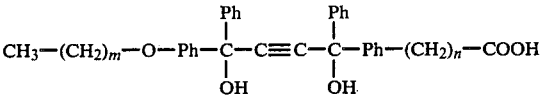

$(30 \geqq m + n \geqq 8, n \geqq 0)$ (II. Diacetylenediol derivatives)

(7)

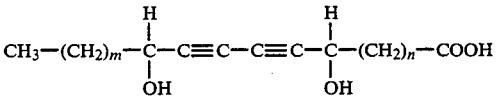

$(30 \geqq m + n \geqq 9, n \geqq 0)$ (8)

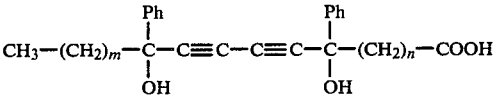

$(30 \geqq m + n \geqq 9, n \geqq 0)$ (9)

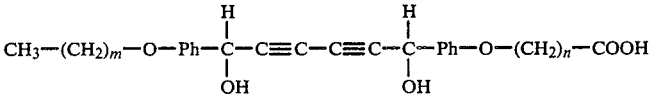

$(30 \geqq m + n \geqq 5, n \geqq 1)$ (10)

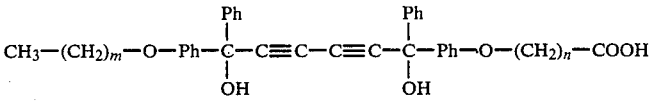

$(30 \geqq m + n \geqq 5, n \geqq 1)$

-continued
(11)
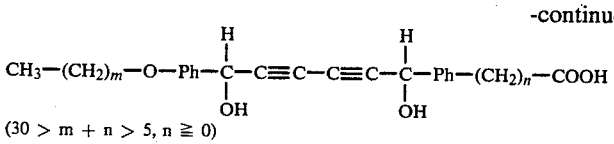
(30 > m + n > 5, n ≧ 0)
(12)
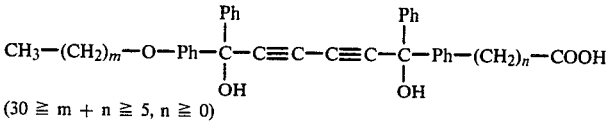
(30 ≧ m + n ≧ 5, n ≧ 0)
(III. Hydroquinone derivatives)
(13)
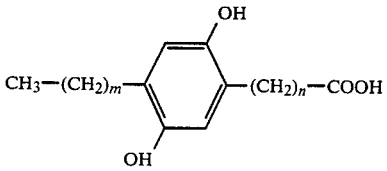
(30 ≧ m + n ≧ 13, n ≧ 0)
(14)
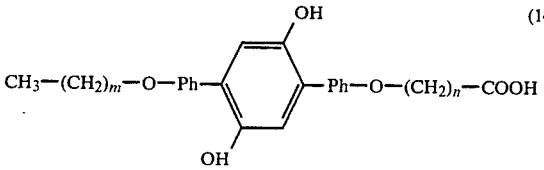
(30 ≧ m + n ≧ 9, n ≧ 1)
(15)
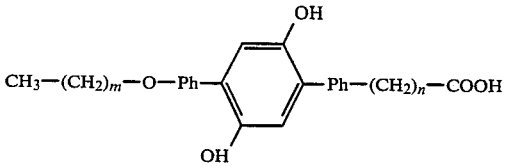
(30 ≧ m + n ≧ 9, n ≧ 0)
(IV. Acetylenediol derivatives)
Z is $-CH_3$ or $-COOH$ hereinafter in (16)-(30).
(16)
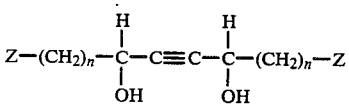
(30 ≧ n ≧ 5)
(17)
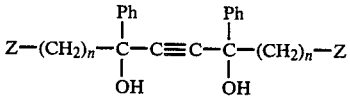
(30 ≧ n ≧ 5)
(18)
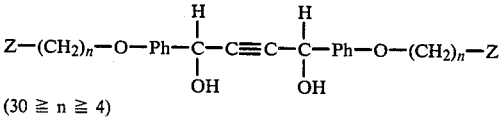
(30 ≧ n ≧ 4)
(19)
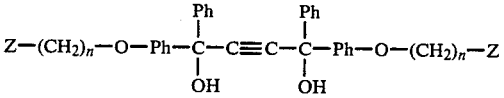
(30 ≧ n ≧ 4)
(20)
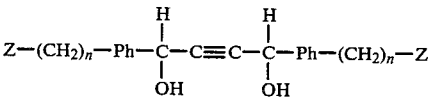
(30 ≧ n ≧ 4)
(21)
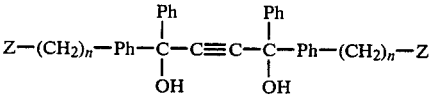
(30 ≧ n ≧ 4)
(V. Diacetylenediol derivatives)
(22)
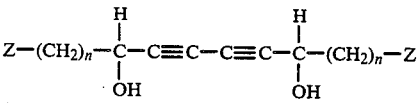
(30 ≧ n ≧ 3)
(23)
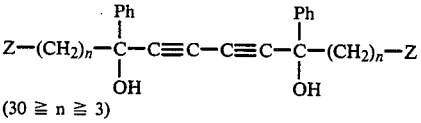
(30 ≧ n ≧ 3)
(24)
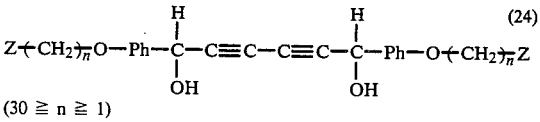
(30 ≧ n ≧ 1)
(25)
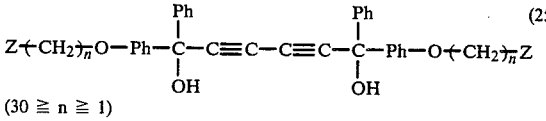
(30 ≧ n ≧ 1)
(26)
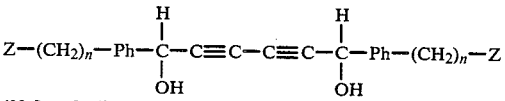
(30 ≧ n ≧ 1)
(27)
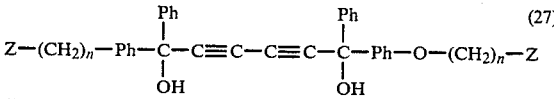
(30 ≧ n ≧ 1)
(VI. Hydroquinone derivatives)

-continued (28)

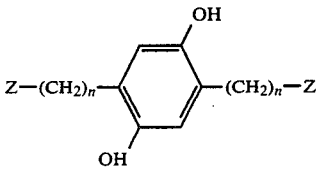

(30 ≧ n ≧ 5)

(29)

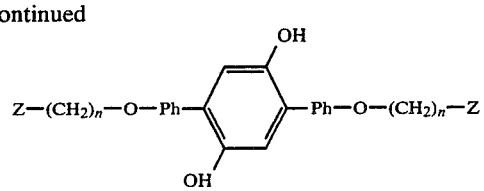

(30 ≧ n ≧ 7)

(30)

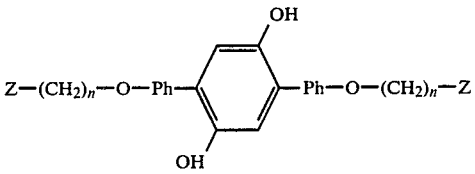

(30 ≧ n ≧ 1)

The foregoing compounds are per se known compounds except that hydrophilic groups or hydrophobic groups are introduced into well known host molecules by substitution of linear alkyl groups, linear carboxyl groups or the like. Formation of crystalline inclusion complexes from host molecules not modified by linear alkyl groups, etc. and various guest molecules is disclosed in Journal of the Chemical Society of Japan (Nippon Kagaku Kaishi) No. 2, pages 239–242 (1983).

It is necessary that the guest molecule to be included by the above host molecule fluoresces by receiving external energy in the monomer state, but fails to emit light when dimerized. Any compound can be used, so long as it is a compound having a site capable of forming a strong hydrogen bond with the host molecule and a suitable steric structure. Structural formulae of applicable and preferable guest molecules are shown below:

(1. Anthracene derivatives)

(31)

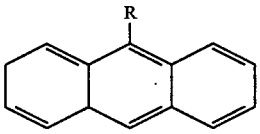

where R is $-CH_3$, $-CH_2OH$, $-CHO$, $-COC_2H_5$ or $-Br$.

(2. Acridinium derivatives)

(32)

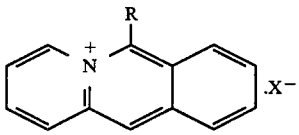

where R is $-H$, $CH_3$, $-C_2H_5$ or $-OH$; and X is $I^-$, $Br^-$, $Cl^-$ or $ClO_4^-$.

(3. Benzacridinium derivatives)

(33)

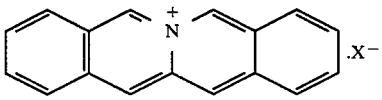

where X is $I^-$, $Br^-$, $Cl^-$ or $ClO_4^-$.

A monomolecular layer is formed from the foregoing two kinds of compounds according to, for example, Langmuir-Blodgett's technique (LB process) developed by I. Langmuir, et al. The LB process is a method for forming a monomolecular layer or a monomolecular layers-built up film by utilizing such a phenomenon that when the balance between the hydrophilic and the hydrophobic properties is properly maintained in the molecular structure, the molecules form a monomolecular layer on a water surface with the hydrophilic groups downward. The monomolecular layer on the water surface has the two-dimensional characteristics, and when molecules are spread sparsely, the equation of two-dimensional ideal gas, $\pi A = kT$, holds between the surface area per molecule, A, and the surface pressure $\pi$, and "a gas film" is formed, where k is the Boltzmann's constant and T is an absolute temperature. If A becomes small enough, the intermolecular action will be intensified, and "a condensed film (or solid film)" of two-dimensional solid will be obtained. The condensed film can be transferred onto the surface of a substrate such as glass, etc., one layer at a time. In the present invention, a monomolecular layer of host molecules including guest molecules (which will be hereinafter referred to as a monocomplexmolecular layer) can be formed in the present invention according to the above technique. As the procedure for the formation, the following two ways A and B can be utilized.

[A] Host molecules and guest molecules are dissolved in a solvent in a ratio according to the composition ratio (molar ratio) of host molecules to guest molecules in a desired inclusion complex, and the resulting solution is spread on a water phase, whereby, inclusion complexes are deposited in a film form, where any host molecule, so long as it has the structure shown by any one of formulae (1) to (15), can be used, irrespectively of the hydrophilic or hydrophobic property of the guest molecules. Thus, inclusion complex molecules are spread on the water surface to form the structure as schematically shown in FIG. 1, where numeral 5 is a water phase, 6 a host molecule and 7 a guest molecule.

Figure 2:
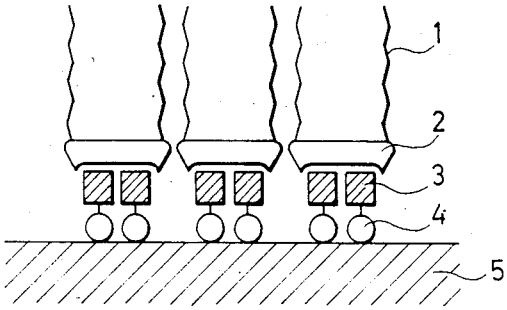

When the host molecule has the structure shown by any one of the formulae (16) to (30) and Z is a methyl group, in the guest molecule part of the inclusion complex molecule must be retained a more hydrophilic moiety relatively to that in the host molecule part. Thus, inclusion complex molecules are spread on the water surface to form the structure as schematically shown in FIG. 2, where numeral 1 is a long chain alkyl group of the host molecule, 2 an inclusion site of the host molecule, 3 an included site of the guest molecule, and 4 a more hydrophilic moiety relatively to the methyl group.

Figure 3:
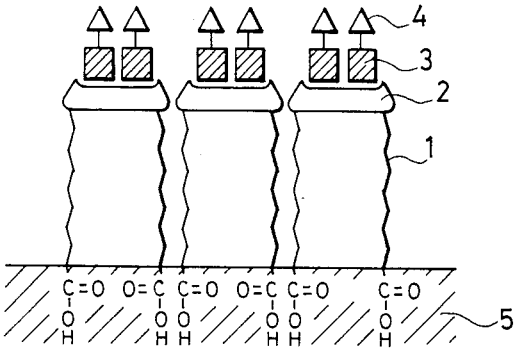

On the other hand, when Z is a carboxyl group, in the guest molecule part of the inclusion complex molecule must be retained a more hydrophobic moiety 4' relatively to the hydrophilic moiety (carboxyl group) in the host molecule part. Thus, inclusion complex molecules are spread on the water surface to form the structure schematically shown in FIG. 3. In forming said inclusion complexes, it is preferable in the present invention that a molar ratio of the host molecules to the guest molecules is about 1:1 or 1:2.

Then, a partition plate (or float) is provided so that said deposits may not be freely and too widely diffused on the water surface, and the aggregation state of film-forming substance is controlled by restricting the spread area to obtain a surface pressure $\pi$ proportional to the aggregation state. A surface pressure $\pi$ suitable for formation of a built-up film can be set by moving the partition plate on the water surface to reduce the spread area, thereby control the aggregation state of film-forming substance and gradually increase the surface pressure. By vertically and gently moving a clean substrate upwardly or downwardly while maintaining the constant surface pressure, a monocomplexmolecular layer can be transferred onto the substrate. The monocomplexmolecular layer can be transferred onto the substrate not only by said vertical dipping technique but also by horizontal deposition technique, by rotary cylinder technique, etc. The horizontal deposition technique is a method for transfer by contacting a substrate with the water surface horizontally, whereas the rotary cylinder technique is a method for transferring the monocomplexmolecular layer onto the surface of a cylindrical substrate from the water surface by rotating the cylindrical substrate on the water surface.

According to said vertical dipping technique, a substrate whose surface is hydrophilic is pulled up from the water across the water surface, and then a monocomplexmolecular layer in which the hydrophilic groups of the host molecules are oriented toward the substrate is formed on the substrate. On the other hand, the horizontal deposition technique is the method of transferring a monomolecular layer by contacting a substrate with the water surface horizontally, and the monocomplexmolecular layer in which the hydrophobic groups of the host molecules are oriented toward the substrate is formed on the substrate. The rotary cylinder technique is the method of transferring a monomolecular layer onto the surface of a cylindrical substrate by rotating the cylindrical substrate on the water surface. Technique for transferring a monomolecular layer onto a substrate is not limited to these techniques. That is, in the case of a substrate of large area, the substrate can be pushed out into water from a substrate roll to transfer the monomolecular layer onto the substrate. Said orientations of the hydrophilic groups or the hydrophobic groups toward the substrate are basic orientations, and can be changed, as desired, by surface treatment of the substrate, etc.

In the foregoing film-forming process, the orientation of film-forming substance in the intrafacial direction has been so far controlled mainly by controlling the surface pressure, and it has been very difficult to obtain a high orderliness, except for film-forming substance of rather simple structure, for example, linear fatty acids, etc. On the other hand, in the present invention, an inclusion complex compound is used as a film-forming substance, and thus a film having a high orderliness can be obtained rather simply. That is, when, inclusion complexes deposits in a film formed on the water surface, steric configurations between the host molecules and guest molecules, between the host molecules and the host molecules and between the guest molecules and the guest molecules are fixed by the hydrogen bond and the van der Waals forces, and the individual host molecules and guest molecules are arranged with crystal lattice-like orderliness. Furthermore, no chemical modification, that is, no introduction of a hydrophobic group and a hydrophilic group, is made up onto the guest molecules as functional molecules, and thus no functional decrease due to the film formation appears.

[B] Water-soluble guest molecules are dissolved in water

Then, host molecules and guest molecules are dissolved in a solvent in a ratio according to the composition ratio (molar ratio) of a desired inclusion complex, and the resulting solution is spread on the water surface to deposit the inclusion complex in a film form. The combination of the host molecules and the guest molecules and the successive film-forming operations can be carried out in the same manner as described above in Section [A].

Figure 4:
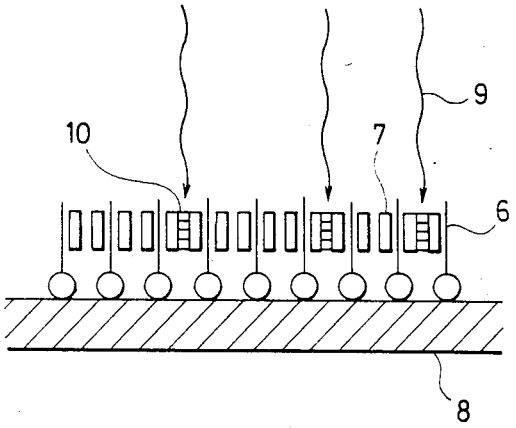
FIG. 4 is a schematic view showing an information input into the light-emitting display component according to the present invention.

One embodiment of a light-emitting display component thus prepared according to the present invention is shown in FIG. 4, where numeral 8 is a transparent substrate.

When the present light-emitting display component thus prepared is subjected to irradiation by light 9, which can supply the necessary energy for dimerizing the guest molecules, such as $\gamma$-rays, X-rays or ultraviolet rays according to given information (pattern), where the guest molecule is, for example, an anthracene derivative of the formula (31), dimerization reaction takes place between the guest molecules according to the following equation (II):

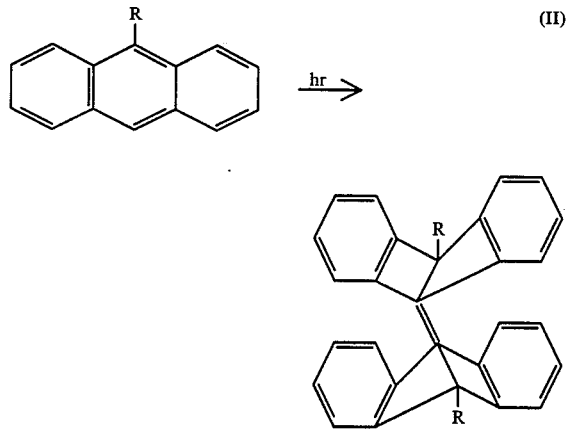

(II)

In the case of acridinium derivatives or benzacridinium derivatives as guest molecules, similar photodimerization reaction takes place. These reactions can take place when the distance between the adjacent unsaturated bonds is less than 4Å, and when the monocomplexmolecular layer is formed in said manner, not only dimers 10 can be readily obtained, but also the steric configuration between the guest molecules in the inclusion complex layer is so regular that only one specie of dimers can be formed among various isomers or structures possible to be formed by the dimerization reaction and the thus formed dimers cannot undergo depolymerization even in the dark place after once dimerized (see FIG. 4).

Figure 5:
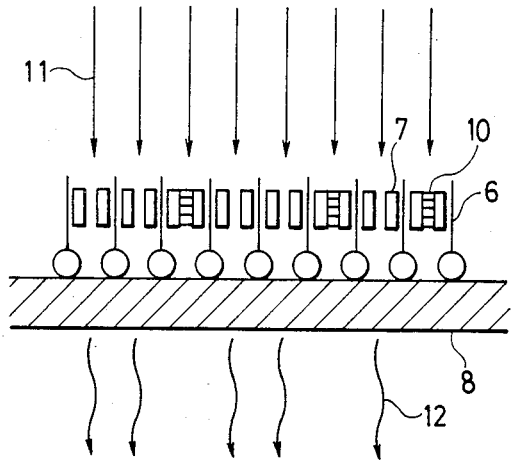
FIG. 5 is a schematic view showing light emission display according to input information.

Information input is made as described above, and display according to the input information, that is, an image formation, is carried out by subjecting the entire surface of the thus dimerized light-emitting display layer to light exposure, for example, by ultraviolet rays 11, etc. That is, by the entire surface light exposure, the guest molecules remaining as monomers emit fluoresent light, but the dimers fail to emit light owing to the breakage of conjugated systems of the monomers. The display (image formation) is based on this principle (see FIG. 5).

Figure 6:
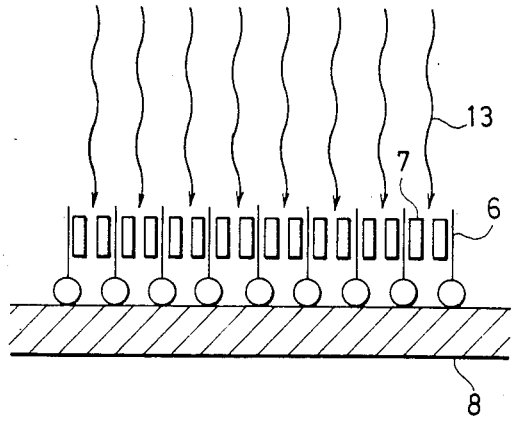
FIG. 6 is a schematic view showing cancellation of the information.

Furthermore, it is possible to depolymerize the dimers to the original monomers by subjecting the dimers to irradiation by light 13 of specific wavelength. That is, the input information, or image can be cancelled thereby (see FIG. 6). In the case of using an anthraquinone derivative as the guest molecules, appropriate light having a specific wavelength is ultraviolet light having the wavelength of 313 nm. The intensity and wavelength of light for the entire surface light exposure must be properly selected so that no photo-dimerization or no photo-depolymerization may occur by the light for the entire surface light exposure, etc. destined to image formation (display). Contrary to said light-emitting display sequence, it is also possible that all of the guest molecules in the light-emitting display layer are dimerized in advance, and the resulting dimers are partially depolymerized according to given information to form an image. When the derivatives (II) or (V) are used as the host molecules, and are subjected to irradiation by the light that can supply the necessary energy for polymerization of the host molecules, such as X-rays, $\gamma$-rays, ultraviolet rays, etc., polymerization takes place at the irradiated sites between the host molecules according to the following equation (III) to form polydiacetylene:

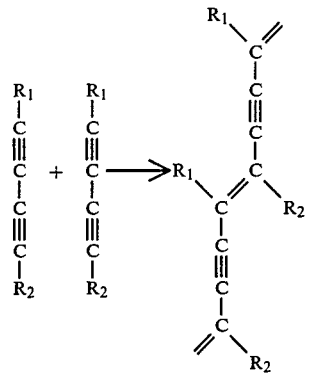

(III)

wherein $R_1$ is $CH-(CH_2)_m-\underset{OH}{\overset{H}{C}}-$, $R_2$ is $HOOC-(CH_2)_n-\underset{OH}{\overset{H}{C}}-$, and $30 \geqq m + n \geqq 9$, and $n \geqq 0$.

Thus, it is possible to drastically increase an adhesiveness between the monocomplexmolecular layer and the substrate by subjecting the layer to the entire surface light exposure. That is, particularly a chemical resistance (solvent resistance) can be increased. By such entire surface light exposure, the guest molecules are also dimerized at the same time, but the dimers can be depolymerized according to a given pattern (information) to form an image, as described above.

In the present component, the monocomplexmolecular layer on the substrate is so strongly fixed to the substrate that no substantial peeling or release from the substrate takes place. To intensify the adhesiveness, an adhesive layer may be provided between the substrate and the monocomplexmolecular layer. Furthermore, the adhesiveness can be also intensified by selecting conditions for forming the monocomplexmolecular layer, for example, a hydrogen ion concentration of water phase, ion species, water temperature, substrate-pulling up or dipping speed, or surface pressure. It is preferable to provide a protective layer on the monocomplexmolecular layer to improve the chemical stability of the monocomplexmolecular layer, but the provision of the protective layer depends entirely on the selection of monomolecular layer forming substance.

The present invention will be described in detail below, referring to Examples.

EXAMPLE 1

Diacetylenediol derivative of the formula (10), where m is 9 and n is 2, and 9-methylanthracene at a molar ratio of the former to the latter of 1:2 were dissolved in chloroform, and the resulting solution was spread on the surface of an aqueous cadmium chloride solution (concentration: $4\times10^{-4}$M) at pH 6.2. By removing the solvent chloroform by evaporation, inclusion complex was deposited in a film form, and then the surface pressure was adjusted to 35 dynes/cm. Then, a glass substrate whose surface was thoroughly clean and hydrophilic was gently dipped across the water surface while maintaining the surface pressure at 35 dynes/cm constant (dipping speed: 2 cm/min). The monocomplex molecular layer was transferred onto the substrate thereby, and a light-emitting display component having the monocomplexmolecular layer as the light-emitting display layer according to the present invention was prepared. A film-forming apparatus, Langmuir-Trough 4, made by Joyce Co, England, was used.

The thus prepared light-emitting display layer was subjected to X-ray irradiation according to a given pattern to dimerize the guest molecules according said equation (II) and input the information. The thus dimerized light-emitting display component was then subjected to entire surface irradiation by ultraviolet ray having the wavelength of 360 nm, whereby blue light was emitted at other sites than the patterned sites. Then, the component was subjected to irradiation by ultraviolet light having the wavelength of 313 nm, whereby the dimers of guest molecules were depolymerized and the input information could be cancelled. In the cases of using host molecule of the formula (25), where Z is a carboxyl group, and n=2, host molecule of the formula (15), where m=9 and n=2, and host molecule of the formula (30), where 2 is a carboxyl group and n=4, similar light-emitting display could be obtained.

EXAMPLE 2

The individual light-emitting display layers prepared in Example 1 were at first subjected to entire surface light exposure by a high pressure mercury lamp to dimerize all the guest molecules. These light-emitting display layers were then subjected to pattern irradiation by ultraviolet light having the wavelength of 313 nm to depolymerize the dimers of guest molecules and input the information. Then, the layers were subjected to entire surface irradiation by ultraviolet light having the wavelength of 365 nm whereby b e light was emitted in the pattern form. Then, by irradiation by X-rays, the guest molecules were dimerized to cancel the input information.

EXAMPLE 3

Diacetylenediol derivative of the formula (7), where m=8 and n=8, as host molecule, and 9-methylanthracene as guest molecule were used to prepare light-emitting display component having a monocomplexmolecular layer as the light-emitting display layer according to the present invention in the same manner as in Example 1. Then, the layer was subjected to the entire surface light exposure by a high pressure mercury lamp to dimerize the guest molecules according to the equation (II) and polymerize the host molecules according to the equation (III). Then, the layer was subjected to pattern irradiation by ultraviolet light having the wavelength of 313 nm to depolymerize the dimers of guest molecules and input the information. Then, the layer was subjected to entire surface irradiation by ultraviolet light having the wavelength of 360 nm, whereby blue light was emitted in the pattern form. By further irradiation by X-rays, the guest molecules were again dimerized to cancel the information. The present light-emitting display component was again subjected to the entire surface light exposure by the high pressure mercury lamp, and then dipped in alcohol for about 30 seconds, and then subjected to information input, display and cancellation in the same manner as above, with the result of no particular problems. That is, by polymerization of the host molecules, it was found the higher adhesiveness of the light-emitting layer to the substrate was obtained. In cases of using 9-hydroxyanthracene, 9-anthraaldehyde or 9-carboxylanthracene as the guest molecule, the similar results were obtained.

EXAMPLE 4

Diacetylenediol derivative of the formula (10), where m=8 and n=2, as host molecule, and acridinium bromide as guest molecule were used to prepare a lighte-emitting display component having a monocomplex-molecular layer as the light-emitting display layer according to the present invention in the same manner as in Example 1. As to the information input and display, blue light-emitting display was obtained in the same manner as in Example 1. Cancellation of the information was carried out by irradiation by the light having the wavelength of 313 nm in the same manner as in Example 1. When acridiniumiodide, 9-methylacridinium iodide, 9-ethylacridinium iodide and 9-hydro yacridinium iodide were used as guest molecules, the similar results were obtained. In the case of 9-hydroxyacridinium iodide, green light was emitted.

EXAMPLE 5

Diacetylenediol derivative of the formula (10), where m=8 and n=2, as host molecule, and benzacridinium iodide as guest molecule were used to prepare a light-emitting display component having a monocomplex-molecular layer as the light-emitting display layer according to the present invention in the same manner as in Example 1. Information input and display were carried out in the same manner as in Example 1, except that the light source for light emission had the wavelength of, 320 nm, and the emitted light was green. Cancellation of the information was carried out by irradiation by light having the wavelength of 365 nm.

As described above, the present light-emitting display component can display high density light emission in a scale of molecular units, where the display can be input or cancelled according to external information. The present light-emitting display component emits light of rather weak intensity that is not sensible directly to human eyes, but can be rather widely utilized as a component for molccular devices, particularly for optical switching circuit.

What I claim is:

1. A light-emitting display component, comprising a light-emitting display layer containing a monomolecular layer of inclusion complex compounds each comprising host molecules having a hydrophilic site, a hydrophobic site and an inclusion site, and the guest molecules included in the host molecules; said guest molecules having a site capable of forming a hydrogen bond with the host molecules and said guest molecules emit light in their monomer state by receiving external energy, and fail to emit light in their dimer state.

2. A light-emitting display component according to claim 1, wherein the host molecule is an acetylenediol derivative, a diacetylenediol derivative, or a hydroquinone derivative.

3. A light-emitting display component according to claim 1, wherein the guest molecule is an anthracene derivative, an acridinium derivative, or a benzacridinium derivative.

4. A light-emitting display component according to claim 1, wherein a molar ratio of the host molecules to the guest molecules is 1:1 or 1:2.

5. A light-emitting display component according to claim 1, wherein the external energy is $\gamma$-rays, X-rays or ultraviolet rays.

6. A method for light-emitting display, comprising (1) subjecting a light-emitting display component comprising a light-emitting display layer containing a monomolecular layer of inclusion complex compounds each comprising host molecules having a hydrophilic site, a hydrophobic site and an inclusion site, and guest molecules included in the host molecules said guest molecules having a site capable of forming a hydrogen bond with the host molecules and, said guest molecules emit light in their monomer state by receiving external energy and fail to emit light in their dimer state, to irradiation by external energy according to given information to thereby dimerize the guest molecules, and then (2) subjecting the light-emitting display component to ultraviolet light exposure to thereby make a display.

7. A method for light-emitting display, comprising (1) subjecting a light-emitting display component comprising a light-emitting display layer containing a monomolecular layer of inclusion complex compounds each comprising host molecules having a hydrophilic site, a hydrophobic site and an inclusion site and guest molecules included in the host molecules, said guest molecules having a site capable of forming a hydrogen bond with the host molecules and the guest molecules emit light in their monomer state by receiving external energy and fail to emit light in their dimer state, to exposure by light having a specific wavelength to thereby dimerize at least the guest molecules, then (2) subjecting the light-emitting display component to irradiation by ultraviolet light having a given wavelength according to a given pattern to thereby depolymerize the dimerized guest molecules, and then (3) subjecting the light-emitting display component to exposure by ultraviolet light having another wavelength to thereby make a display.

8. A light-emitting display component according to claim 1, wherein the monomolecular layer is a Langmuir-Blodgett film.

9. A light-emitting display component according to claim 1, wherein the host molecules are selected from the group consisting of:

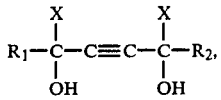

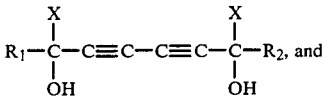

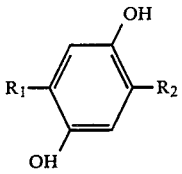

wherein X is a hydrogen atom or a phenyl group, and $R_1$ and $R_2$ are each linear alkyl groups having 5 to 30 carbon atoms or fatty acid groups having 1 to 30 carbon atoms.

10. A light-emitting display component according to claim 1, wherein the guest molecules are an anthracene derivative having the formula:

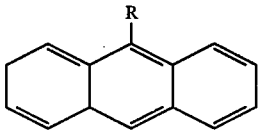

wherein R is $—CH_3$, $—CH_2OH$, —CHO, $—COC_2H_5$ or —Br.

11. A light-emitting display component according to claim 1, wherein the guest molecules are an acridinium derivative having the formula:

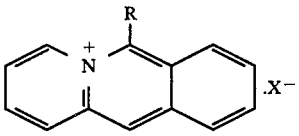

wherein R is —H, $—CH_3$, $—C_2H_5$ or —OH, and X is $I^-$; $Br^-$, $Cl^-$ or $ClO_4^-$.

12. A light-emitting display component according to claim 1, wherein the guest molecules are an benzacridinium derivative having the formula:

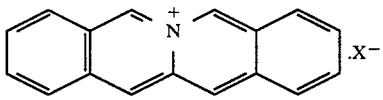

wherein X is $I^-$, $Br^-$, $Cl^-$ or $ClO_4^-$.

13. A method for light-emitting display according to claim 6, wherein the monomolecular layer is a Langmuir-Blodgett film.

14. A method for light-emitting display according to claim 6, wherein the host molecules are selected from the group consisting of:

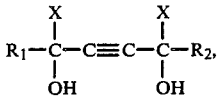

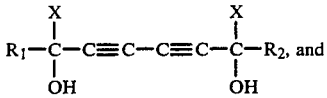

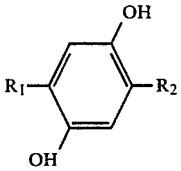

wherein X is a hydrogen atom or a phenyl group, and $R_1$ and $R_2$ are each linear alkyl groups having 5 to 30 carbon atoms or fatty acid groups having 1 to 30 carbon atoms.

15. A method for light-emitting display according to claim 6, wherein the guest molecules are an anthracene derivative having the formula:

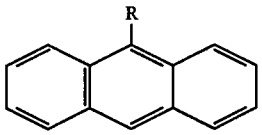

wherein R is $—CH_3$, $—CH_2OH$, —CHO, $—COC_2H_5$ or —Br.

16. A method for light-emitting display according to claim 6, wherein the guest molecules are an acridinium derivative having the formula:

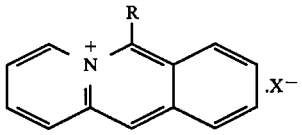

wherein R is —H, $—CH_3$, $—C_2H_5$ or —OH, and X is $I^-$; $Br^-$, $Cl^-$ or $ClO_4^-$.

17. A method for light-emitting display according to claim 6, wherein the guest molecules are an benzacridinium derivative having the formula:

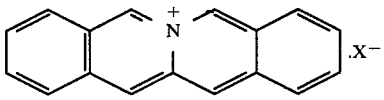

wherein X is $I^-$, $Br^-$, $Cl^-$ or $ClO_4^-$.

18. A method for light-emitting display according to claim 7, wherein the monomolecular layer is a Langmuir-Blodgett film.

19. A method for light-emitting display according to claim 7, wherein the host molecules are selected from the group consisting of:

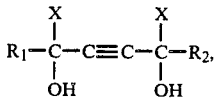

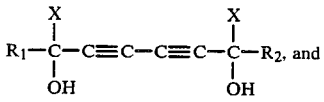

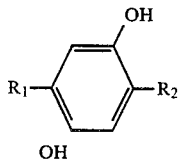

wherein X is a hydrogen atom or a phenyl group, and $R_1$ and $R_2$ are each linear alkyl groups having 5 to 30 carbon atoms or fatty acid groups having 1 to 30 carbon atoms.

20. A method for light-emitting display according to claim 7, wherein the guest molecules are an anthracene derivative having the formula:

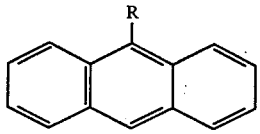

wherein R is $-CH_3$, $-CH_2OH$, $-CHO$, $-COC_2H_5$ or $-Br$.

21. A method for light-emitting display according to claim 7, wherein the guest molecules are an acridinium derivative having the formula:

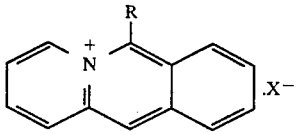

wherein R is $-H$, $-CH_3$, $-C_2H_5$ or $-OH$, and X is $I^-$; $Br^-$, $Cl^-$ or $ClO_4^-$.

22. A method for light-emitting display according to claim 7, wherein the guest molecules are an benzacridinium derivative having the formula:

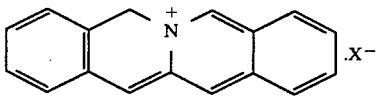

wherein S is $I^-$, $Br^-$, $Cl^-$ or $ClO_4^-$.

* * * * *